US005322604A

United States Patent [19]

Cawlfield

[11] Patent Number: 5,322,604

[45] Date of Patent: Jun. 21, 1994

[54] ELECTROLYTIC CELL AND ELECTRODES THEREFOR

[75] Inventor: David W. Cawlfield, Cleveland, Tenn.

[73] Assignee: Olin Corporation, Stanford, Conn.

[21] Appl. No.: 970,500

[22] Filed: Nov. 2, 1992

[51] Int. Cl.[5] ..... C25B 11/03; C25B 9/00

[52] U.S. Cl. ..... 204/257; 204/263; 204/284

[58] Field of Search ..... 204/252-258, 204/263-266, 284, 280

[56] References Cited

U.S. PATENT DOCUMENTS

| | | | |
|---|---|---|---|
| 4,013,525 | 3/1977 | Emsley | 204/98 |
| 4,121,990 | 10/1978 | Boulton | 204/258 |
| 4,124,478 | 11/1978 | Tsien et al. | 204/255 |
| 4,204,939 | 5/1980 | Boulton et al. | 204/258 |
| 4,252,628 | 2/1981 | Boulton et al. | 204/257 |
| 4,256,551 | 3/1981 | Cliff et al. | 204/98 |
| 4,464,243 | 8/1984 | Woolhouse | 204/257 |
| 4,533,455 | 8/1985 | Balko et al. | 204/279 |
| 4,571,288 | 2/1986 | Boulton | 204/98 |
| 4,608,144 | 8/1986 | Darwent | 204/257 |
| 4,784,735 | 11/1988 | Sorenson | 204/98 |
| 4,822,461 | 4/1989 | Brattan et al. | 204/98 |
| 5,041,196 | 8/1991 | Cawlfield et al. | 204/101 |
| 5,064,514 | 11/1991 | Cawlfield et al. | 204/103 |
| 5,084,149 | 1/1992 | Kaczur et al. | 204/101 |
| 5,108,560 | 4/1992 | Cawlfield et al. | 204/103 |

*Primary Examiner*—Donald R. Valentine

*Attorney, Agent, or Firm*—H. Samuel Kieser; William A. Simons

[57] ABSTRACT

An electrode and an electrolytic cell in which the electrode includes a plate having electrode material attached to at least one side thereof. A header opening is provided in the electrode plate and has a plurality of slots radiating therefrom towards the center of the plate. The electrolytic cell includes an electrode spaced from a separator such as a membrane or diaphram by a gasket member of universal design. The electrodes, separator and gaskets have a header opening extending therethrough with slots radiating from the header openings in the anode and cathode plates to provide fluid communication between anode and cathode chamber and the header.

20 Claims, 3 Drawing Sheets

ELECTROLYTIC CELL AND ELECTRODES THEREFOR

This invention relates generally to electrolytic cells, and more particularly to a monopolar cell design for electrolysis and electrodes therefor.

Electrolytic cells are well-known and generally comprise at least one anode and cathode with each anode being separated from an adjacent cathode by separators such as a diaphram or membrane which divides the electrolytic cell into anode and cathode compartments. The cell components are provided with a means for feeding an electrolyte to and from the anode and cathode compartments. This feeding means, particularly in multi-compartment cells having a plurality of anode and cathode compartments, may include headers formed by openings in the individual components of the cell and which are in communication with the anode and cathode compartments. A plurality of headers may be provided for feeding an anolyte to and from the anode compartments and a catholyte to and from the cathode compartments.

Some cell designs utilize an electrode formed from an electrode plate having an electrode material attached thereto. In many electrochemical processes, the materials used for the electrode plate and/or the electrode material are fabricated from an electrically conductive metal such as platinum, titanium and niobium. These metals are not only expensive, but are difficult to machine accurately. To minimize expense, it is important that efficient use is made of the material. Additionally, it is desirable that complex machining is minimized to reduce manufacturing costs. This is especially true where the electrode is used in a multi-compartment cell wherein provision must be made for feeding electrolyte to each of the anode and cathode compartments through anolyte and catholyte headers.

SUMMARY OF THE INVENTION

In view of the above, it is an object of the present invention to provide an improved electrode of a simplified design.

It is another object of the present invention to provide an electrode having a simplified design to provide for feeding electrolyte to the electrolyte compartment when the electrode is assembled in the cell.

It is a further object of the present invention to provide an electrode including a plate provided with a header which maximizes the surface area of the backplate available for attachment of the electrode material.

It is still another object of the present invention to provide an improved electrolytic cell.

It is yet another object of the present invention to provide an electrolytic cell utilizing components having a universal design.

These and other objects of the present invention may be achieved through the provision of an electrode for use in an electrolytic cell which may include an electrode plate having an electrode material attached to at least one side thereto. An electrode header opening is provided in the plate with a plurality of slots radiating from the header toward the interior of the plate. The electrode material covers a portion of the surface of said plate.

An electrolytic cell constructed in accordance with the present invention may include an anode plate having an anode material attached thereto, a cathode plate having a cathode material attached thereto and a separator. A gasket member is provided between the anode plate and said separator and between the cathode plate and the separator to form an anode chamber and a cathode chamber respectively. An anolyte header opening extends through said anode plate, cathode plate, gasket and separator and a catholyte header opening extends through said anode plate, cathode plate, gasket and membrane. The anode plate has a plurality of slots extending through said plate and radiating from said anode header towards the interior of said anode plate and said cathode plate has slots through said plate radiating from said header opening towards the interior of said cathode plate.

BRIEF DESCRIPTION OF THE DRAWINGS

The present invention may be better understood by reference to the following detailed description and to the accompanied drawings in which.

DETAILED DESCRIPTION OF THE INVENTION

Figure 1:
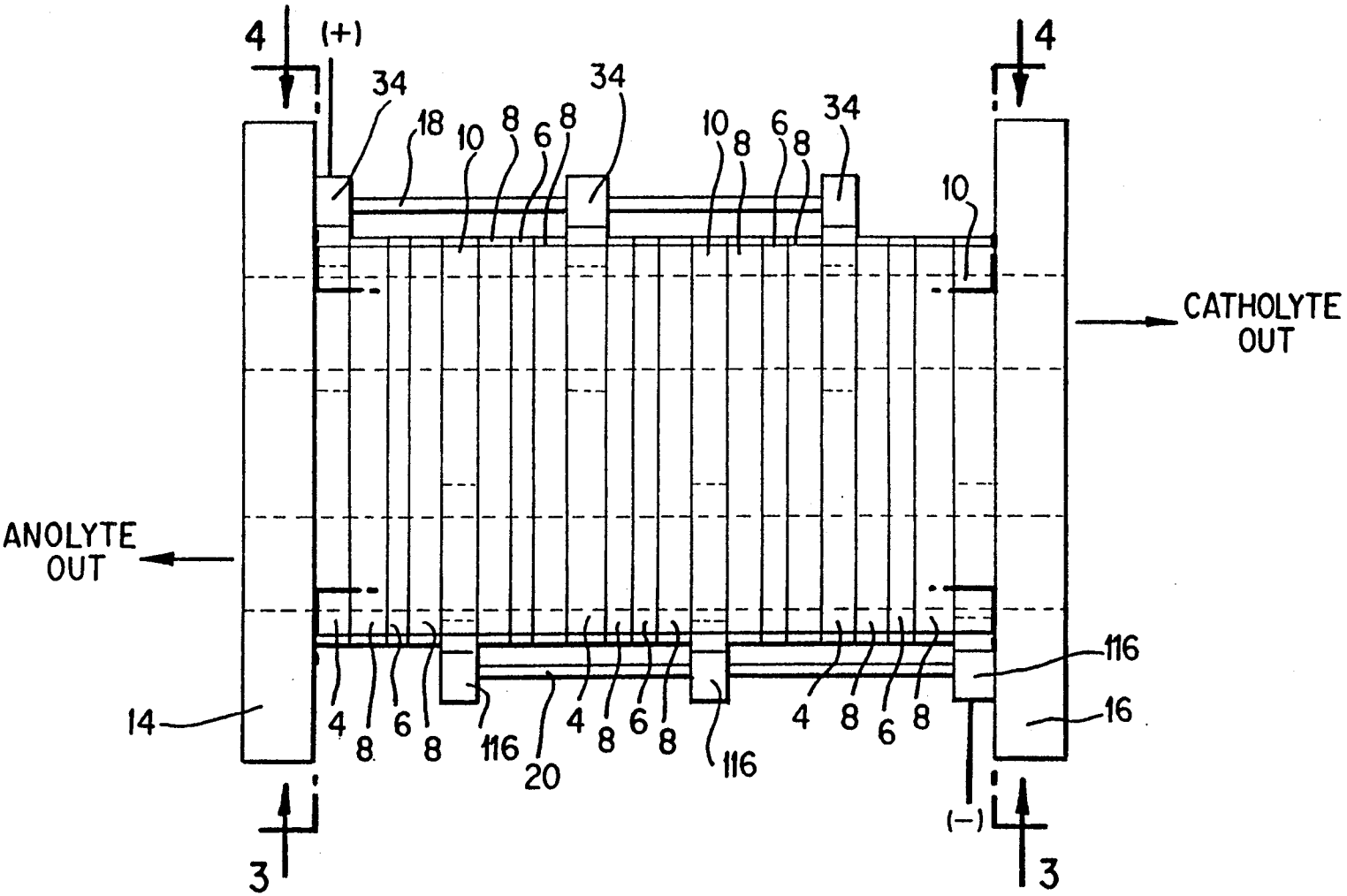
FIG. 1 is a partial schematic top plan view of a multi-compartment cell constructed in accordance with the present invention.

FIG. 1 shows a top plan view of an electrolytic cell constructed according to the present invention. The cell shown is a multi-compartment monopolar cell which may be used in the electrolysis of various chemical solutions. An example of the use to which cells of the type to be described herein may be used in the electrolysis of an aqueous solution of hypochlorous acid to yield chloric acid such as described in U.S. Pat. No. 5,108,560 issued Apr. 28, 1992. Another example of the use of a cell constructed in accordance with the present invention is for the production of chlorine dioxide from dilute alkali metal chlorite solutions as described in U.S. Pat. No. 5,041,196, issued Aug. 20, 1991. Depending upon the particular type of anode and cathode materials used, the present invention will have application to a wide variety of electrochemical processes.

As shown in FIG. 1, the cell includes a plurality of compartments formed by horizontally stacking a plurality of cell components. The cell components generally include an anode 4 spaced from a separator 6 such as a membrane or diaphram by a gasket 8. On the other side of the membrane 6 is a cathode 10 spaced from the membrane 6 by another gasket.

The cathode 10 is spaced from a second membrane 6 by means of a gasket 8. As shown in FIG. 1, there are three alternating anodes 4 and cathodes 10 with an associated gasket 8 and separator 6 horizontally stacked between end frame members or bulkheads 14 and 16 respectively as shown to form a multi-compartment cell. The bulkheads 14 and 16 are compressed together by suitable means (not shown for the sake of clarity) to hold the cell in assembled condition. A suitable insulating material (not shown) is provided between the bulkheads 14 and 16 and the left most anode 4 and right most cathode 10 to electrically insulate them from the bulkhead. All the anodes 4 are connected to suitable buss work 18 to connect the anode 4 to the positive side of an appropriate power source. Similarly, appropriate buss work 20 connects all the cathodes 10 to connect the cathode 10 to the negative side of an appropriate power source. The power source should be designed so that during cell operations, typical current densities such as from about 1 to about 10 and preferably from about 2 to about 6 ka/m$^2$ may be employed.

Figure 2:
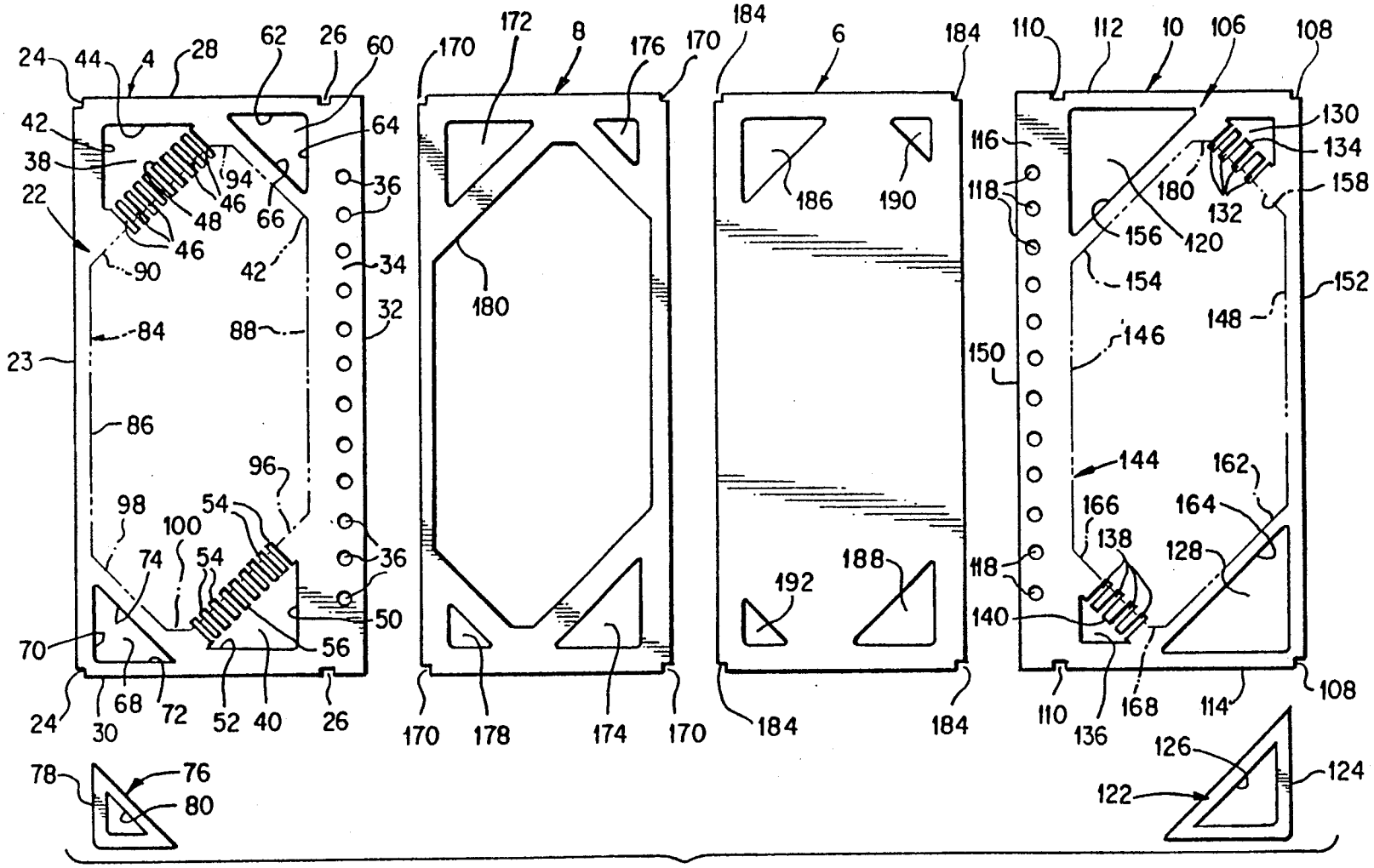
FIG. 2 is a side view of the various components forming a compartment of the cell shown in FIG. 1.

FIG. 2 shows the design of the various components of the cell of the present invention. The anode 4 comprises a generally rectangular anode plate 22. At the top and bottom of one side edge 23 of the anode plate 22 are half notches 24 which serve to align the anode plate 22 with the other components of the electrolytic cell during assembly. Full notches 26 in the upper and lower edges 28 and 30 of the anode plate 22 are spaced from the notches 24 across a portion of the width of the plate 22. That portion of the anode plate extending from a line passing through the centers of the notches 26 to the right-hand side edge 32 of the plate 22 as viewed in FIG. 2 forms an elongated tab portion 34 in which a series of apertures 36 are provided. The tab portion 34 with the apertures 36 therein is designed to extend outwardly from the edges of the other elements of the cell to provide a means for connecting the electrical buss work to the anode plate 22 to supply positive current thereto.

Diametrically opposed anolyte header opening 38 and 40 are provided in the anode plate 22 and are identical in shape. As shown in FIG. 2, these header openings 38 and 40 are triangular-shaped with the upper header opening 38 defined by one side 42 of the triangle extending essentially parallel to and spaced from the side edge 23 of the anode plate 22. A second side 44 is parallel to and spaced from the top edge 28 of the anode plate 22 a predetermined distance. A plurality of slots 46, extending completely through the thickness of the anode plate 22, radiate from the edge 48 of the opening 32 defining the hypotenuse of the triangular shape opening 38 in a direction perpendicular thereto toward the interior of the plate 22 as shown.

The lower anolyte header opening 40 is positioned in the lower corner opposite the upper corner in which the opening 38 is provided. The vertical side 50 defining this opening 40 is spaced from the outer edge 32 of the plate 22 a distance such that the distance between that side 50 and a line passing through the center of the notches 26 is substantially equal to the distance between the side 23 and side 42 of the upper header 38. The distance between the bottom side 52 and the bottom edge 30 of the plate 22 is the same as the distance between the upper side 44 of the opening 38 and upper edge 28 of the plate 22. Similar to the upper header opening 38, a plurality of slots 54, extending completely through the thickness of the plate 22, radiate perpendicular from the edge 56 defining the hypotenuse of the triangular-shaped opening 50 toward the interior of the plate 22.

An upper catholyte header opening 60 is provided in an upper corner opposite to the anolyte header opening 38. The catholyte header 60 is generally triangular shaped and is defined by a first side 62 extending parallel to and spaced from the upper edge 28 of the anode plate 22 a predetermined distance. A second side 64 defining the opening 60 extends parallel to and is spaced inwardly from the side edge 32. An edge portion 66 defining the catholyte header opening 60 forms the hypotenuse of the triangularly-shaped opening.

A lower catholyte header opening 68, identical in shape to the upper catholyte header opening 60 extends through the anode plate 22 in the lower left-hand corner thereof diametrically opposed to the catholyte header opening 60. This header opening 68 is similarly triangularly-shaped and includes a vertical side portion 70, parallel to the side edge 23 of the plate 22 and spaced therefrom a distance equal to the distance of the side 64 of the header opening 60 from a vertical line passing through the center of the notches 26. A horizontal side 72 extends parallel to the edge 30 of the plate 22 and is spaced therefrom a distance equal to the distance of the side 62 of the upper header 60 from the upper edge 28. The opening 68 is further defined by an edge portion 74 forming the hypotenuse of the triangularly-shaped opening.

The upper and lower catholyte header openings 60 and 68 are each adapted to have a gasket insert 76 positioned therein when the anode plate 22 is assembled in a cell. The gasket insert 76 has an outer triangular periphery 78 conforming to the triangular surface defining the openings 60 and 62. The gasket insert 76 also has a triangularly shaped header opening 80 therein defining the catholyte header when aligned with the other elements of the cell. The gasket inserts 76 have a thickness the same as or slightly greater than the thickness of the anode plate 22.

The anode plate 22 is adapted to have a suitable anode material 82 (see FIGS. 3 and 4) attached to at least one of its flat sides. The anode material 82 has a vertical cross sectional shape indicated by the phantom line 84 in FIG. 2. As indicated, vertical outer edges 86 and 88 of the anode material extend generally parallel to and are spaced from the vertical outer edges 23 and 32 of the plate 22. The upper edge is defined by a first portion 90 extending parallel to the edge 48 forming the hypotenuse of the upper anolyte header opening 38 and a second portion 92 extending parallel to the hypotenuse edge 66 of the upper catholyte header opening 60. A small straight edge portion 94, parallel to the upper edge 28 of the plate 22, connects these two upward edge portions 90 and 92 of the anode material. Similarly, the bottom edge of the anode material 82 is defined by edge portions 96 and 98 which extend parallel to and are spaced from the hypotenuse edge portion 56 of the lower anolyte header 40 and the hypotenuse edge portion 84 of the lower catholyte header opening 68 respectively. A straight portion 100, parallel to the bottom edge 30 of the plate 22, connects these two portions 96 and 98.

It is to be noted that the slots 46 and 54, radiating from the anolyte header openings 38 and 40 respectively, extend from the edge 48 or 56 of their respective header opening inwardly in the plate 22 past the line 90 or 92 defining the edge of the anode material 82. Accordingly, the anode material 82 will overlap a portion of each of the slots 46 and 56 in the plate 22.

The cathode 10 includes a cathode plate 106 which has the same rectangular outer shape as the anode plate 22. The plate 106 has upper and lower half notches 108 at the upper and lower right-hand corners as shown and a full notch 110 in both the upper edge 112 and lower edge 114 for alignment purposes. The portion of the cathode plate 106 extending horizontally outwardly to the left as shown in FIG. 2 from a vertical line passing through the mid-points of the notches 110 constitutes a tab portion 116 having apertures 118 therein similar to that in the anode plate 22 for connection of the bus work to the cathode 10 to provide a negative current to the plate 106. The tab portion 116 thereof extends from the other components of the cell in a direction opposite to the tab portion 34 of the anode plate 22 when assembled.

A triangular upper anolyte header opening 120 in the cathode plate 106 is orientated in an upper portion of the plate adjacent to the tab portion 106. The anolyte header opening 120 in the cathode plate 100 is positioned so that it is in horizontal alignment and coaxial with the anolyte header opening 38 in the anode plate 22 when the plates are stacked. However, the opening 120 is larger than the opening 38 in the anode plate 22 so that it can accommodate a gasket insert 122 which is mounted in the opening 120 when the cell is assembled. The gasket insert 122 has an outer peripheral surface 124 conforming to the triangular peripheral surface defining the opening 120. The gasket 122 also has a triangular header opening 126 therein conforming in size and shape to the opening 38 in the anode plate 22. The gasket insert 122 has a thickness the same as or slightly greater than the thickness of the cathode plate 106.

The cathode plate 106 also includes a lower anolyte header opening 128, triangular in shape, and positioned so that it is in horizontal coaxial alignment with the lower anolyte header opening 40 in the anode plate 22 when stacked. Similar to the upper anolyte header opening 120, the lower opening 128 is enlarged with respect to the opening 40 in the anode plate 22 to receive a gasket 116 with the triangular opening 126 formed therein in alignment with the lower anolyte header opening 68 in the anode plate 22 when the gasket 122 is inserted in opening 128 and the plates are assembled.

An upper triangular-shaped catholyte header opening 130 is located adjacent to the upper corner of the cathode plate 106 having the half notch 108 therein. However, the opening 130 is smaller than the catholyte header opening 60 in the anode plate 60 and is so shaped and positioned that it is substantially the same size as the opening 80 in the triangular-shaped gasket 76 mounted in the catholyte header opening 60 the anode plate 22 and is in alignment therewith when the cell is assembled. A plurality of slots 132 extending through the thickness of the cathode plate 106 and radiate from the edge 134 of the opening 130 defining the hypotenuse of the triangular opening in a direction perpendicular thereto toward the middle of the plate 106.

A lower catholyte header opening 136 is provided adjacent to the lower corner of the cathode plate 106 diametrically opposed to the corner containing the upper opening 130. The lower opening 136 has a size and shape identical to that of the upper opening 130. The opening 136 is positioned so that it aligns with the opening 80 of the gasket 76 mounted in the lower catholyte opening 68 in the anode plate 22 when the plates are assembled in the cell. As in the case of the upper catholyte opening 130, the lower catholyte header opening 136 has a plurality of slots 138 extending through the thickness of the plate 106 and radiating perpendicularly to the edge 140 of the opening 134 defining the hypotenuse of the triangular-shaped opening 136 inwardly toward the middle of the plate 106 as shown.

Figure 4:
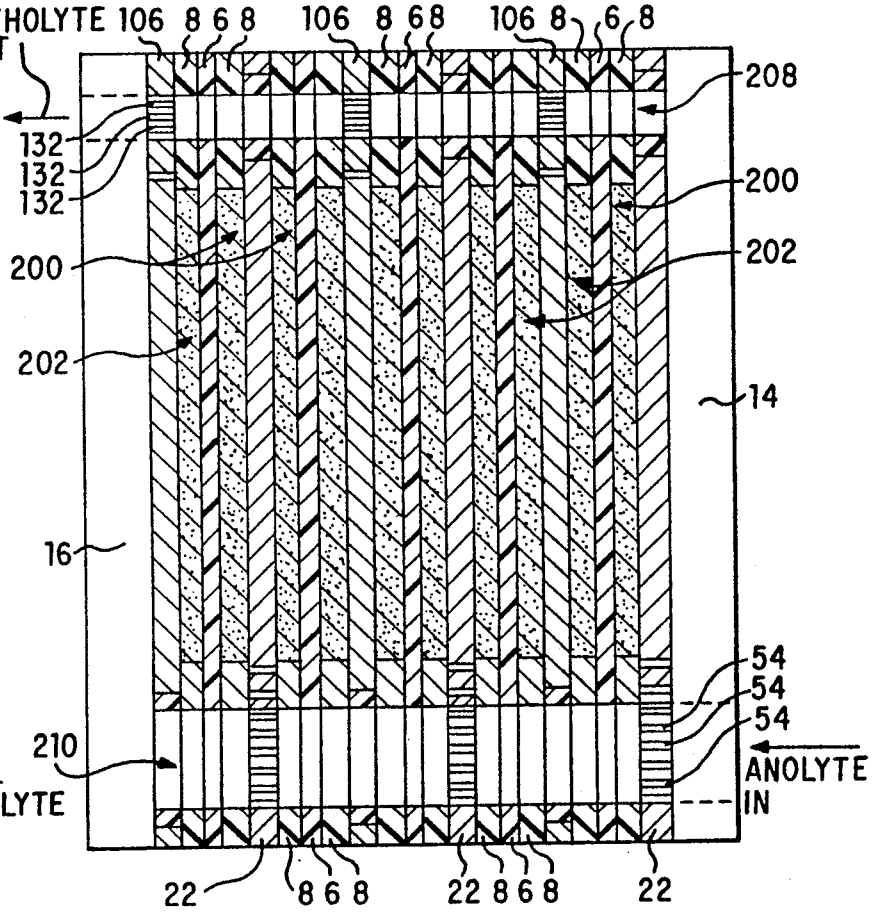
FIG. 4 is a sectional view taken along the lines 4—4 of the cell of FIG. 1.
Figure 3:
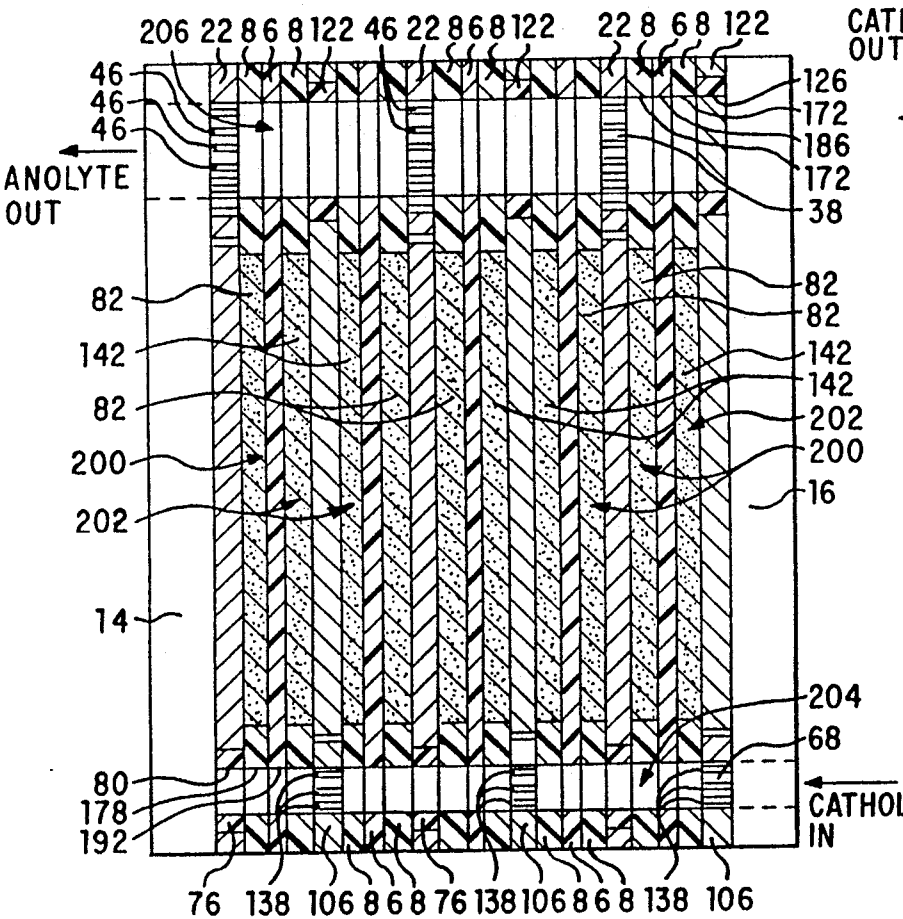
FIG. 3 is a sectional view of the cell of FIG. 1 taken along the lines 3—3 of FIG. 1.

The cathode plate 106 is adapted to have a cathode material 142 attached thereto as shown in FIGS. 3 and 4. The cathode material 142, when attached to the plate 106, has an outer periphery of the shape shown by the phantom line 144 in FIG. 2. As can be seen, the cathode material 142 has substantially the same outer periphery in vertical cross-section as the anode material 84. The outer periphery is defined by vertical side edges 146 and 148 extending parallel to, but spaced from the outer side edges 150 and 152 respectively of the cathode plate 106. The upper edge is defined by a first edge portion 154 which is parallel to and spaced from the edge portion 156 of the anolyte header opening 120 defining the hypotenuse of the triangular-shaped opening. A second upper edge portion 158 extends parallel to and is spaced from the edge portion 134 forming the hypotenuse of the upper catholyte header opening 130. The two upper edge portions 154 and 158 are connected by a straight edge portion 180 parallel to the upper edge 112 of the cathode plate 106. Similarly, the bottom edge of the cathode material 142 is defined by a first bottom edge portion 162 extending parallel to and spaced from the edge portion 164 defining the hypotenuse of the lower triangular-shaped anolyte header opening 128 and a second lower edge portion 166 extending parallel to and spaced from the edge portion 140 forming the hypotenuse of the lower catholyte header opening 136. A straight edge portion 168 parallel to the bottom edge 114 of the cathode plate 106 connects the two edge portions 162 and 166 as shown.

As will be noted in FIG. 2, the slots 132 extending from the upper catholyte header opening 130, as well as the slots 138 extending from the lower catholyte opening 136, extend from the hypotenuse edge portion 134 or 140 of its respective opening to a point that is the interior of the edge portion of the cathode material so that the cathode material 142 overlaps a portion of the inner ends of the slots 132 and 138 as shown.

A universal gasket design is provided so that a gasket 8 of the same design may be used in conjunction with either the cathode plate 22 or the anode plate 106. The gasket 8 is generally rectangular and has a height equal to the height of the anode and cathode plates 22 and 106. The width of the gasket 6 is equal to the distance from the edge 23 of the anode plate 22 having the half notch therein to a line extending vertically through the middle of the notches 26. The gasket 8 has a half notch 170 in each of its corners as shown for alignment purposes.

The pattern of header openings in the gasket is such that the various header openings align with corresponding header openings in the anode plate 22 and cathode plate 116. In this regard, an upper anolyte header opening 172 is provided in the gasket which has the same shape anolyte and size as the anolyte header opening 38 in the anode plate 22. Thus, the anolyte header opening 172 is triangular in shape and is so located in the gasket 8 that it will align with the anolyte header opening 42 in the anode plate 22 and the opening 126 in the gasket insert 122 in anolyte header opening 120 in the cathode plate 106. A bottom anolyte header opening 174 is provided in the gasket diametrically opposed to the upper anolyte header opening 172. The size and shape of the opening 174 is the same as that of the opening 172. The opening 174 is positioned in the gasket 8 such that it will align with the lower anolyte opening 40 in the anode plate 22 and the opening 126 in the gasket insert 122 in the lower anolyte opening 125 in the cathode plate 106 when it is assembled in the cell.

The gasket 8 also has upper and lower catholyte header openings 176 and 178. These openings are the same size and triangular shape as the upper and lower catholyte header openings 130 and 136 in the cathode plate 106. The catholyte header openings 176 and 178 are so positioned in the gasket 8 that they will align with the openings 130 and 136 respectively in the cathode plate 106 as well as the opening 80 in the gasket insert 76 positioned in the catholyte header openings 60 and 68 in the anode plate 22 when assembled in the cell.

The center of the gasket 8 contains an opening 180 therethrough having a shape corresponding to the peripheral shape of the anode material 82. The opening 180 is defined by edges 182 corresponding in shape to the edges 84 of the anode material. Thus, a gasket 8 can be positioned against either the anode plate 22 or the cathode plate 106 and the anode material 84 or cathode material 142 will extend into the opening 180 of the gasket and be surrounded by the edge 182 thereof when the cell is assembled. The gasket itself will be in sealing engagement with the surface of an anode plate or cathode plate when assembled.

The membrane 6 is generally rectangular-shaped and has an outer configuration the same as that of the gasket 8 and includes alignment notches 184 in each of its corners. Like the gasket 8, the membrane 6 has an upper triangular anolyte header opening 186, a lower anolyte header opening 188, an upper triangular catholyte header opening 190 and a lower triangular catholyte header opening 162. Each of these openings 186, 188, 190 and 192 has the same size and shape as the corresponding header opening 192, 174, 176 and 178 respectively, in the membrane 8. Each header opening 186, 188, 180 and 192 in the membrane 6 also has the same relative position in the gasket 6 as the corresponding opening 172, 174, 176 and 178 in the gasket 8 so that each header opening in the membrane will align with a respective header opening in the gasket 8.

FIGS. 3 and 4 show the components of FIG. 2 assembled into a multi-compartment cell. The various components are stacked horizontally with an anode plate 22 positioned at the left-hand side of FIG. 3 as shown. As this particular anode plate is positioned next to the frame member 14, only one side of that anode plate 22 has the anode material 82 attached thereto. A gasket 8 is positioned against the anode plate 22 with the anode material 82 extending into the opening in the center of the gasket 8. A membrane 6 is positioned against the gasket 8. The thickness of the gasket 8 determines the spacing of the anode plate 22 from the membrane 6, as well as the spacing of the anode material 82 from the membrane 6. A gasket 8 is provided on the other side of the membrane 6 between that membrane 6 and a cathode plate 106. The cathode plate 106 has cathode material 142 attached to both sides thereof, so the cathode material extends from one side into the opening 180 in the gasket 6 toward the membrane 8. On one side of the cathode plate and from the other side into an opening 180 in a gasket 6 toward a membrane 8 positioned on the other side of the cathode plate 106 The thickness of the gasket 6 between the membrane 8 and the cathode plate 106 determines the spacing of the cathode material 142 from the membrane 6. The next anode plate 22 has anode material 82 extending from both sides of its flat surface through a gasket 8 toward a membrane 6 This arrangement is continued except that the right most cathode as shown in FIG. 3 is positioned against the frame member 16 and only has cathode material 142 extending from its side opposite the frame member to the left as shown.

Except for the outermost anode plates and cathode plates which are positioned against the end plates 14 and 16 respectively, the anodes and cathodes have electrode material on either side of their respective backing plate. Each such anode has an anode compartment 200 on either side of it. Similarly, each such cathode plate has a cathode compartment 200 on either side thereof. A plurality of such components may be stacked to provide a multi-compartment cell with as many compartments as deemed feasible.

As shown in FIG. 3, the lower catholyte openings of the various components align to form a lower catholyte header 204 from which the catholyte flows inwardly to the various catholyte compartments 202. As will be noted, the slots 138 in the catholyte plates 106 connecting with the lower catholyte header 204 permit the catholyte to flow into the cathode compartments 202 on either side of a cathode plate 116. Also as shown in FIG. 3, the upper anolyte openings of the various components align themselves to form an upper anolyte header 206. The slots 46 in the anode plates 22 connect with the various anode compartments 200 to permit the anolyte to flow from the anode compartments 200 into the header 206

As shown in FIG. 4, the upper catholyte openings in the various components are in horizontal alignment to form a upper catholyte header 208. The slots 132 in the catholyte plates 106 communicate with the catholyte compartments 200 on either side of the cathode plate 106 to permit the catholyte to flow from the catholyte compartment into the upper catholyte header 204. Similarly, the lower anolyte openings of the various components are all in alignment to form a lower anolyte header 210 extending through the cell. The slot in the anolyte plates 22 communication 54 with the anode compartments 200 to permit the flow of anolyte from the lower anolyte header 210 into the anode compartments 200.

The gasket inserts 76 in the catholyte openings 38 and 68 in the anode plate 22 prevent the catholyte from contacting an anode plate 22 or anode material 82. Similarly, the gasket inserts 122 in the anolyte openings 120 and 128 in the cathode plates 106 prevent the anolyte from contacting the cathode plate 106 and the cathode material 142.

As a portion of the slots extending from the respective anode or cathode header openings are covered by a gasket when the cell is assembled, the width of the slots 46 and 132 should be less than the thickness of this respective anode and cathode plate 22 and 106 so that the gasket material does not flow into the slots to an extent to block the flow of fluid from the header into the anode or cathode compartment when the cell is assembled. The gasket 8, when assembled against the plate, cover only the portion of the slots adjacent to the header opening, leaving the inner tip portions of the slots uncovered so that the electrolyte can flow into its respective chamber. Also, since the anode and cathode material 84 and 142 is spaced from the edges of their assorted plates 22 and 102 as well as the header openings, the gaskets are able to effectively seal the edges of the anode and cathode chamber.

By way of example, and depending upon the particular electrochemical process for which the various components are to be used, the anode material 84 attached to an anode plate 22 may be porous, being formed, for example, from a coated wire cloth or expanded mesh or fiber in a structure which allows the anolyte to flow in all three dimensions. Materials which can be employed in the anode structures include platinum, platinum group metals, metal substrates coated with platinum or platinum group metals, lead dioxide and metal substrates coated with lead dioxide. Suitable metal substrates include the valve metals such as titanium and niobium among others. The backing plate may be fabricated from a suitable electrically conductive material which is resistant to the electrolyte such as titanium or niobium or such materials as the platinum group metals, the platinum group metals coated on a substrate or valve metal such as titanium or niobium. The anode material may be attached to the anode plate by any suitable means such as spot welding or the like.

The cathode plate by way of example, may be fabricated from suitable resistant stainless steel alloys such as Hastelloy ® material, platinum group metals or metals plated with the platinum group metals. The cathode material may be a mesh-type structure fabricated from suitable materials and made, for example, from Hastelloy ® C-22 structure having an outer 100-mesh screen layer support suggested on a coarse (6 wire per inch) inner mesh layer and spot welded to the cathode plate.

The material of a separator 6 will depend upon the particular electrochemical process, but generally may comprise a cation exchange membrane. Such membranes are well-known to contain fixed anionic groups that permit intrusion and exchange of cations and exclude anions from an external source. Resins which may be used to produce the membranes include, for example, fluorocarbons, vinyl compounds, polyolefins, hydrocarbons and copolymers thereof. An example of a suitable membrane is a cation permeable fluoropolymer base membrane sold under the tradename Nafion ® 117 by E.I. DuPont de Nemours & Company.

The gasket material forming both the gasket 8 and gasket inserts 76 and 122 may be an oxidation-resistance rubber or plastic elastomer material. Suitable materials include rubber-type material such as EPDM that is sold under the trademark Vitron ®, etc. Other suitable types of gasket materials include flexible closed foam types made from polyethylene and polypropylene.

The thickness of the electrode plates is generally from about 1 millimeter to about 25 millimeters and is optimized to attain a minimum total of operating and installation costs. The width of the electrode elements is normally no larger than about 1000 millimeters in width. It has been found that a length-to-width ratio of from about 1.5:1 to about 8:1 and preferably 2:1 to about 4:1 is desirable.

With the above arrangement, a minimal number of components are required for each unit cell of a multicompartment cell. With the particular gasket design, a single die can produce gaskets for all chambers, with the gasket thickness determining the cell compartment thickness. This allows many different anode and cathode designs to be attached to its respective plate.

In addition, with the design described above, machining is minimized as the electrode plates are made by forming cuts through the metallic plate stock by water jet machining, rather than routing channels into the metal plate at a prescribed depth. The cell may also be made by laser cutting or electron beam cutting.

While the preferred form of the header openings is triangular in shape as described above to maximize the effective area available for attachment of the electrode material thereto, other shapes may be used for the openings. For example, header openings may be circular in shape with slots radiating from the circumference thereof into the interior of the plate.

As an alternative to the notches provided in the various cell compartments for alignment purposes, each cell compartment may instead be provided with a V notch in the bottom edge. Also, the anode and cathode plate may be provided with a vertical extension portion which extends vertically upwardly beyond the upper edge of the gasket and membrane when the cell is assembled. The vertical extension portion may have a hole therethrough on a vertical center-line lying in a vertical plane extending perpendicular to the plates and passing through the center of the gasket and membrane when the cell is assembled. A rod may be passed through these holes to assist in alignment during assembly. Spaced slots may also be provided in the vertical extension portion on either side of the hole to provide a means for lifting the assembled cell.

While the invention has been described above with reference to specific embodiments thereof, it is apparent that many changes, modifications and variations can be made without departing from the inventive concept disclosed herein. Accordingly, it is intended to embrace all such changes, modifications and variations that fall within the spirit and broad scope of the appended claims. All patents cited herein are incorporated by reference in their entirety.

What is claimed is:

1. An electrode for use in an electrolytic cell comprising:

an electrode plate having an electrode material attached to at least one side thereof, an electrolyte header opening in said plate, and a plurality of slots in said plate radiating from said header opening toward the interior of the plate, said electrode material covering a portion of the surface of said plate.

2. The electrode of claim 1 wherein said electrode plate is generally rectangular.

3. The electrode of claim 1 wherein the width of said slots is less than the thickness of said electrode plate.

4. The electrode of claim 1 wherein said header opening is generally triangular.

5. The electrode of claim 1 wherein said electrode plate includes a tab portion for connection of electrical current thereto.

6. The electrode of claim 1 wherein the electrode material is present on both sides of said plate.

7. The electrode of claim 1 wherein the electrode material overlaps a portion of said slots.

8. An electrode for use in an electrolytic cell, said electrode comprising:

an electrode plate, an electrode material on at least one side of said electrode plate, a first anolyte header opening in said plate adjacent one corner of said plate, a second anolyte header opening in said plate adjacent a diametrically opposite corner from said first anolyte header opening, a first catholyte header opening in said plate adjacent a corner opposed to one of said anolyte header openings, a second catholyte header opening is said plate adjacent a corner diametrically opposed to said first catholyte header opening, and a plurality of slots in said plate radiating from either said catholyte header openings or said anolyte header openings toward the interior of the plate, said electrode material covering a portion of said plate.

9. The electrode of claim 8 wherein said header openings not having said slots associated therewith have a gasket mounted therein, said gasket having an opening therethrough and having a thickness at least as great as the thickness of said plate.

10. The electrode of claim 8 wherein each of said header openings has a triangular shape with the edges of the opening defining the sides of a triangle being parallel to a respective side of said plate.

11. The electrode of claim 8 wherein said slots have a width less than the thickness of said plate.

12. The electrode of claim 8 wherein one edge of said electrode plate include a tab portion for attachment of a negative current thereto.

13. The electrode of claim 12 wherein said corners of said plate spaced from said tab portion have alignment notches therein and the upper and lower edges of said electrode plate have a notch therein defining the beginning of said tab portion.

14. An electrolytic cell comprising:

an anode plate having an anode material attached thereto, a cathode plate having a cathode material attached thereto, a separator, a gasket member provided between said anode plate and said separator and between said cathode plate and said separator to form an anode chamber and a cathode chamber respectively, an anolyte header extending through said anode plate, cathode plate, gasket and separator, a catholyte header extending through said anode plate, cathode plate, gasket and separator, said anode plate having a plurality of slots extending therethrough and radiating from said anode header towards the interior of said anode plates and said cathode plate having slots therethrough and radiating from said cathode header towards the interior of said cathode plate.

15. The electrolyte cell of claim 14 wherein said slot in said anode plate extend from said anode header to a point where the anode material overlaps a portion of the slot, and the slot in said cathode plate extending from said cathode header to a point where the cathode material overlaps a portion of the slots.

16. The cell of claim 14 wherein said cell comprises a plurality of anode plates, cathode plates, gaskets and separators stacked together to form a multi-compartment cell, at least of one said anode plates having anode material on both sides thereof and at least one of said cathode plates having a cathode material on both sides thereof.

17. The electrolytic cell of claim 14 wherein said header openings are triangular-shaped.

18. The electrolytic cell of claim 14 wherein said anode plate includes a tab portion along one edge thereof extending outwardly of said cell from said gasket and said cathode plate has a tab portion extending outwardly in a direction opposite from said tab portion of said anode plate from said gasket.

19. The electrolytic cell of claim 14 wherein the cathode header openings in said anode backing plate has a gasket insert mounted therein and said cathode header openings in said anode plate have a gasket insert positioned therein, said gasket inserts having a thickness at least as great as its respective plate.

20. The electrolyte cell of claim 14 wherein said gasket member between an anode plate and membrane has an opening therein into which the anode material extends with that gasket being in sealing engagement with the anode plate and exposing the inner ends of the slots therein, and said gasket member between said cathode plate has an opening therein into which the cathode material extends with that gasket being in sealing engagement with the cathode plate and exposing the inner ends of the slots therein.

* * * * *